US006407704B1

(12) United States Patent
Franey et al.

(10) Patent No.: US 6,407,704 B1
(45) Date of Patent: Jun. 18, 2002

(54) PATCH ANTENNA USING NON-CONDUCTIVE THERMO FORM FRAME

(75) Inventors: John Philip Franey, Bridgewater; Keith V. Guinn, Basking Ridge; Louis Thomas Manzione, Summit; Ming-Ju Tsai, Livingston, all of NJ (US)

(73) Assignee: Lucent Technologies Inc., Murray Hill, NJ (US)

( * ) Notice: Subject to any disclaimer, the term of this patent is extended or adjusted under 35 U.S.C. 154(b) by 0 days.

(21) Appl. No.: 09/425,373

(22) Filed: Oct. 22, 1999

(51) Int. Cl.[7] ..... H01Q 1/38
(52) U.S. Cl. ..... 343/700 MS; 343/829
(58) Field of Search ..... 343/700 MS, 829, 343/848, 846, 872, 873; H01Q 1/38

(56) References Cited

U.S. PATENT DOCUMENTS 4,596,915 A * 6/1986 Simpson ..... 343/700 MS
5,614,915 A * 3/1997 Webb ..... 343/770
5,633,645 A * 5/1997 Day ..... 343/700 MS
5,896,107 A * 4/1999 Huynh ..... 343/700 MS
5,963,181 A * 10/1999 Abe ..... 343/700 MS
5,977,710 A * 11/1999 Kuramoto et al. ... 343/700 MS
5,990,835 A * 11/1999 Kuntzsch et al. .... 343/700 MS
6,008,763 A * 12/1999 Nystrom et al. ..... 343/700 MS
6,025,803 A * 2/2000 Bergen et al. ..... 343/700 MS
6,054,953 A * 4/2000 Lindmark ..... 343/700 MS
6,061,032 A * 5/2000 Sandstedt et al. ..... 343/770
6,118,405 A * 9/2000 Mckinnon et al. ... 343/700 MS
6,271,801 B2 * 8/2001 Tuttle et al. ..... 343/872

* cited by examiner

*Primary Examiner*—Hoanganh Le
*Assistant Examiner*—Trinh Do Dinh
(74) *Attorney, Agent, or Firm*—Christopher N. Malvone

(57) ABSTRACT

A patch antenna's resonators are supported by a non-conductive frame. The frame supports the resonators without making holes in the resonators and thereby avoids the problem of creating unwanted electric field polarizations. Additionally, the frame grasps the resonators in areas of low current density and thereby avoids creating additional disturbances in the radiation pattern. In one embodiment of the invention, the frame includes a perimeter lip that snaps over the edges of the feedboard and thereby attaches the frame to the feedboard.

4 Claims, 3 Drawing Sheets

PATCH ANTENNA USING NON-CONDUCTIVE THERMO FORM FRAME

Cross Reference To Related Inventions

This application is related to the following commonly assigned an concurrently filed U.S. Patent Applications entitled "Patch Antenna", Ser. No. 09/425,374; and "Patch Antenna Using Non-Conductive Frame, Ser. No. 09/425, 368.

BACKGROUND OF THE INVENTION

1. Field of the Invention

The present invention relates to antennas; more particularly, patch antennas.

2. Description of the Prior Art

FIG. 1 illustrates an exploded view of a prior art patch antenna assembly. Non-conductive front housing 10 and conductive rear housing 12 form the outer surfaces of the antenna assembly. The two sections of the housing enclose multi-layered feedboard 14, resonators 16 and 18 and spacers 20. Spacers 20 are attached to front side 22 of feedboard 14 by screws 24. Screws 24 mate with threads on the inside of spacers 20 by passing through holes 26 in feedboard 14. Resonators 16 and 18 are attached to spacers 20 in a similar fashion. Screws 28 mate with threads on the inside of spacers 20 by passing through holes 30 in resonators 16 and 18. The spacers are chosen so that they provide a space of approximately 1/10 of a wavelength at the frequency of operation between-feedboard 14 and resonators 16 and 18. The assembled feedboard, spacers and resonators are mounted inside of the enclosure formed by front housing 10 and rear housing 12. A signal to be transmitted by the antenna assembly is provided to conductor 40 of multi-layered feedboard 14. Conductor 40 is typically positioned on one layer of feedboard 14 such as on top layer 42. An insulating layer is typically provided between conductor 40 and a ground plane layer of feedboard 14. The ground plane layer 22 normally has openings or slots 44 which allow the signal from conductor 40 to couple to resonators 16 and 18 so that the signal can be transmitted through front housing 10.

FIG. 2 provides a more detailed illustration of the assembled feedboard 14, spacers 20 and resonators 16 and 18. Screws 24 pass through holes in feedboard 14 to mate with the threaded inside portion of spacer 20. Similarly, screws 28 pass through holes in resonators 16 and 18 to mate with the threaded inside portion of spacers 20.

This prior art patch antenna assembly suffers from several shortcomings. The assembly is expensive to assemble because of the many individual parts such as eight spacers and 16 screws. The spacers are expensive to mass produce because they include threaded inner portions. Additionally, the holes made through resonators 16 and 18 to allow screws 28 to mate with spacers 20 create unwanted patterns in the radio frequency energy radiated by the antenna assembly. For example, if the antenna is being used for a horizontally polarized transmission, the holes introduce additional non-horizontal polarizations in the transmitted signal.

SUMMARY OF THE INVENTION

The present invention solves the aforementioned problems by providing a nonconductive frame that supports the resonators. The frame supports the resonators without making holes in the resonators and thereby avoids the problem of creating unwanted electric field polarizations. Additionally, the frame grasps the resonators in areas of low current density and thereby avoids creating additional disturbances in the radiation pattern. In one embodiment of the invention, the frame includes a perimeter lip that snaps over the edges of the feedboard and thereby attaches the frame to the feedboard without using additional components such as screws.

DETAILED DESCRIPTION OF THE INVENTION

Figure 1:
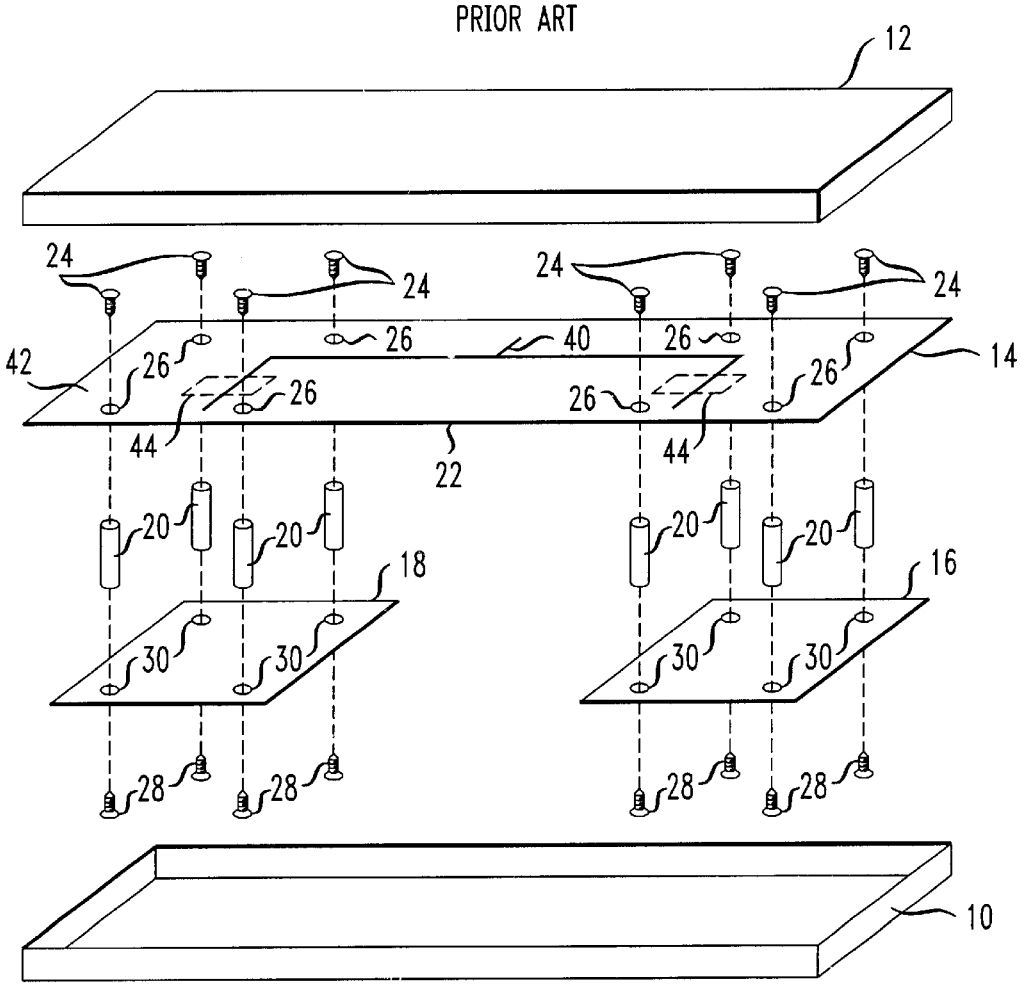
FIG. 1 PRIOR ART
FIG. 1 illustrates a prior art patch antenna assembly.
Figure 2:
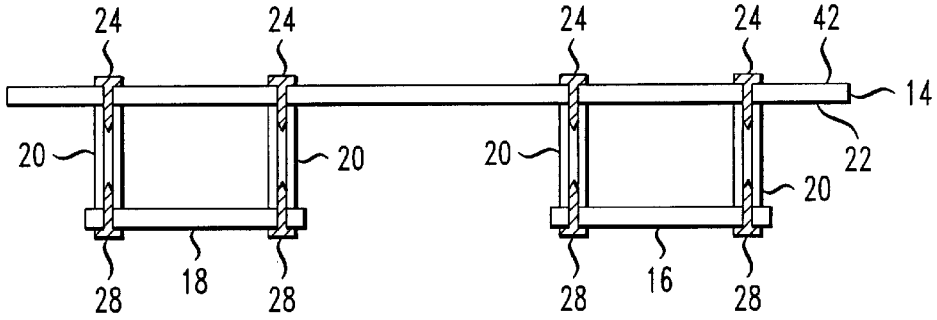
FIG. 2 PRIOR ART
FIG. 2 illustrates a prior art feedboard, spacer and resonator assembly.
Figure 3:
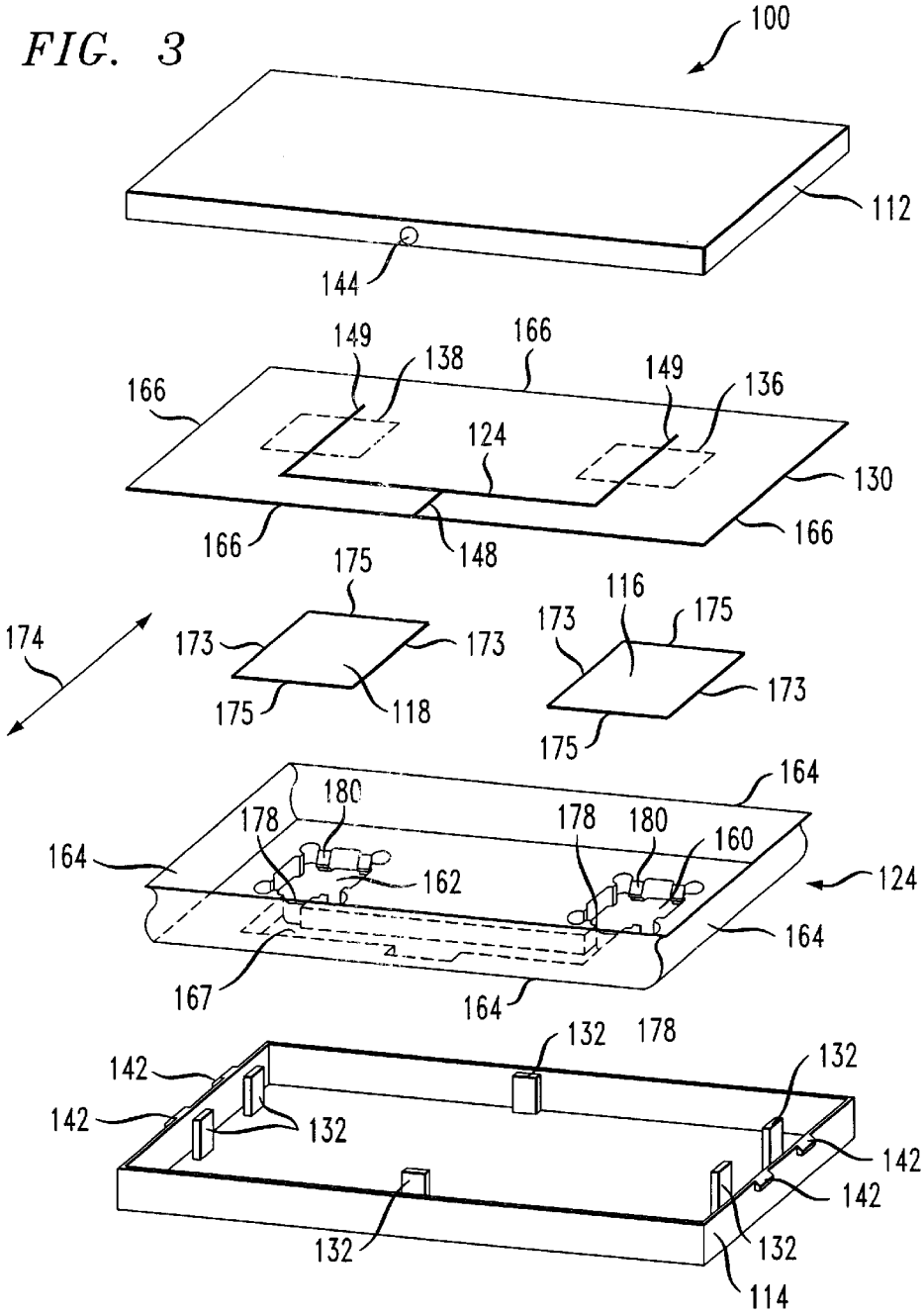
FIG. 3 illustrates an exploded view of a patch antenna assembly having non-conductive frames.

FIG. 3 illustrates patch antenna assembly 100. The assembly is enclosed by conductive rear housing section 112 and non-conductive front housing section 114. Resonator elements 116 and 118 are held in non-conductive frame 124. Feedboard is positioned in front housing section 114 by positioning tabs 132. Feedboard 130 is multilayered and contains a ground plane, a plane containing conductor 134, and insulating layers on the top and bottom surfaces and between conductor 134 and the ground plane. Slots 136 and 138 in the ground plane permit a radio frequency (RF) signal on conductor 134 to couple to resonators 116 and 118 so that RF energy may be transmitted through front housing section 114. Rear housing section 112 mates with front housing section 114 and locks in place by interacting with locking tabs 142. Rear section 112 contains opening 144 which provides a passage through which a conductor can pass for attachment to point 148 on conductor 134.

Non-conductive frame 124 is a thermo-formed using a non-conductive material such as Lexan® 101 plastic which is available from General Electric Company (LEXAN® is a registered trademark of General Electric Company). It should be noted that frame 124 may be manufactured as two parts rather than one part, or if there are more than two resonators, a separate frame may be used for each resonator. Resonators 116 and 118 are snapped into resonator receptacles 160 and 162, respectively, of frame 124. Perimeter lip 164 of frame 124 snaps over edges 166 of feedboard 130. It should be noted that frame 124 may have perimeter lip along two opposite edges rather than all four edges. This configuration is particularly useful when a separate frame is used for each resonator. The frame holds resonators 116 and 118 approximately 1/10 of a wavelength at the-frequency of operation away from feedboard 130. Frame 124 also includes channel 167 that is positioned over conductor 134 and attachment point 148. Channel 167, is approximately 2 mm deep and it reduces any stray capacitance or inductance that the frame may introduce to conductor 134. Front housing section 114 includes tabs 132 that assist in the alignment or placement of the assembly comprising feedboard 130, frame 124 and resonators 116 and 118 into front housing section 114.

Figure 4:
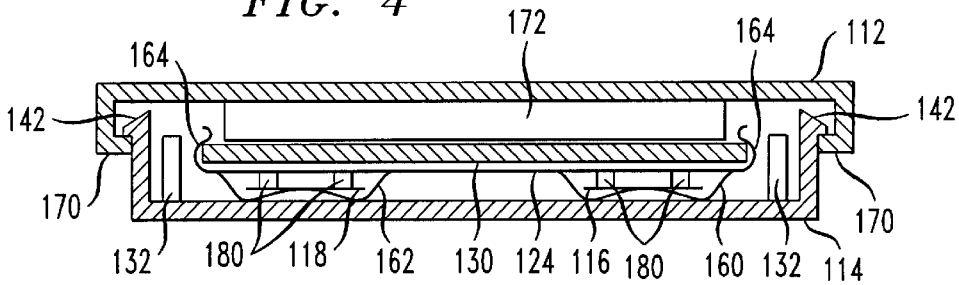
FIG. 4 illustrates a cross section of an assembled patch antenna system having non-conductive frames.

FIG. 4 illustrates a cross section of antenna assembly 100. Interlocking tabs 142 and 170 hold front housing sections 114 and 112 together. Resonators 116 and 118 are supported in resonator receptacles 160 and 162 of frame 124, respectively. Retention tabs 180 hold the resonators in their respective receptacles. As mentioned earlier, the frame may be attached to feedboard 130 by snapping frame perimeter lip 164 over feedboard edges 166; however, it is also possible to maintain the relationship between the frame and feedboard using a compression force provided by rib 172 of rear housing section 112. Placement of feedboard 130 in front housing section 1 14 is facilitated by placement tabs 132. Rear housing section 112 includes a series of parallel ribs 172. When sections 114 and 112 are interlocked using tabs 170 and 142, ribs 172 press down on the components beneath them so that the components are effectively compressed between ribs 172 and the inner surface of front housing section 114.

In reference to FIG. 3, it should be noted that the radio frequency (RF) signal on conductor 134 couples to the resonators through sections 149 of conductor 134 which pass over slots 136 and 138. The desired dominant polarization direction 174 is shown. When the RF signal couples to the resonators, the higher current densities on the resonators occur on the sides of the resonators that are parallel to conductor sections 149. As a result, side sections 172 of resonators 116 and 118 contain the higher current densities. In order to limit interfering with the higher current densities, it is desirable that resonator receptacles 160 and 162 minimize contact with the resonators along side sections 173. In order to minimize this contact, resonator receptacles 160 and 162 make contact with the resonators along lower current density perimeter surfaces 175 using retention tabs and support surfaces or ridges positioned along resonator receptacles sides 176 and 178.

Figure 5:
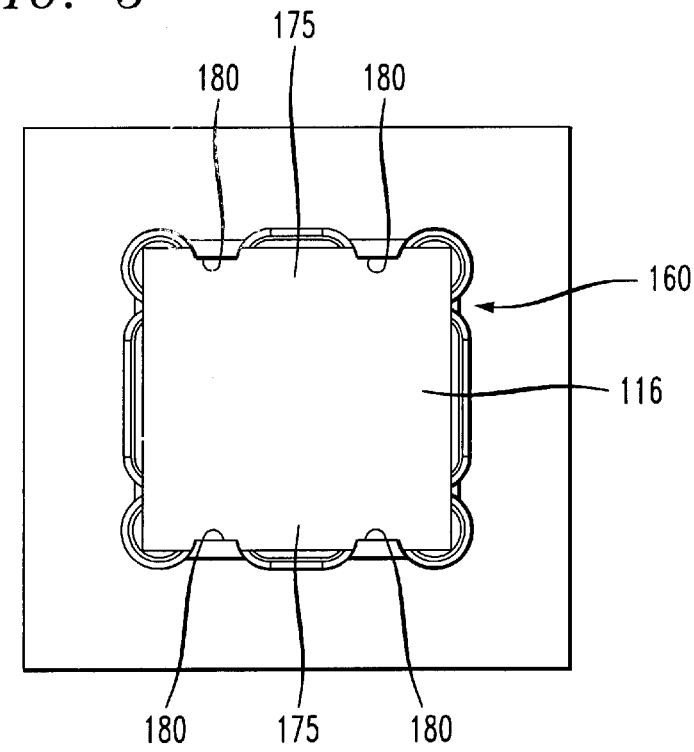
FIG. 5 illustrates a resonator receptacle with a resonator inserted.

FIG. 5 illustrates resonator receptacle 160 with resonator 116 snapped into position. Retention tabs 180 hold resonator 116 in place. It should be noted that retention tabs 180 make contact with resonator 116 along perimeter surfaces 175 where the current densities are lower.

Figure 6:
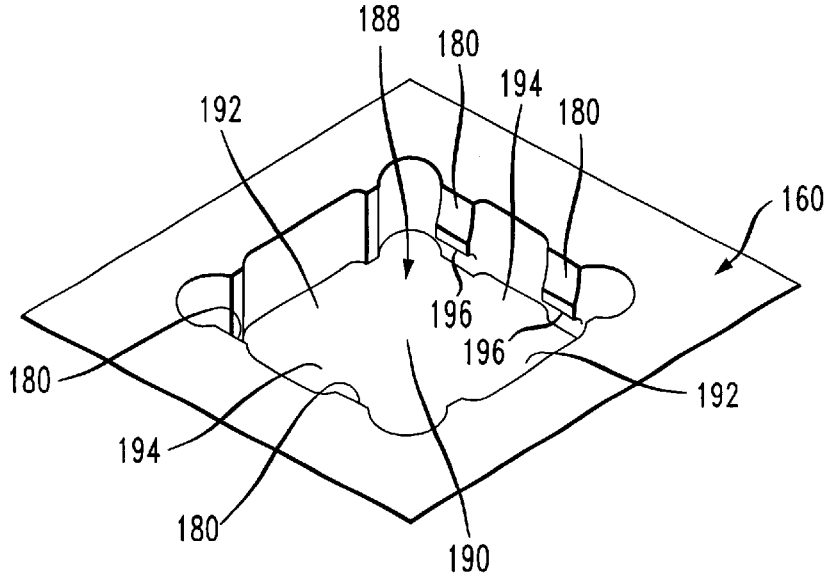
FIG. 6 illustrates a resonator receptacle without a resonator inserted.

FIG. 6 illustrates resonator receptacle 160 without resonator 116 inserted. Inner surface 188 of resonator receptacle 160 is shaped such that center portion 190 is higher than side portions 192 and 194. This results in center section 190 providing tension to hold the edges of resonator 116 against lower surfaces 196 of retention tabs 180. It should be noted that by making side sections 192 lower than raised center section 190, contact with high current density sections 173 of resonator 116 is minimized when the resonator is snapped into resonator receptacle 160.

The invention claimed is:

1. An antenna assembly, comprising:

a signal feedboard having at least one signal conductor, and at least one ground plane with an opening, where at least a portion of the signal conductor is positioned across the opening;

a resonator having a planar surface; and a nonconductive frame having a perimeter lip on at least two edges, where the perimeter lip fits over at least two edges of the signal feedboard and where the nonconductive frame grasps the resonator with the planar surface facing the opening and with the planar surface being substantially parallel to the signal feedboard.

2. The antenna assembly of claim 1, where the nonconductive frame comprises at least one resonator receptacle with an inner surface where a center portion of the inner surface is higher than a side portion of the inner surface.

3. The antenna assembly of claim 1, where the nonconductive frame comprises at least one resonator receptacle with at least one retention tab that contacts the resonator along a lower current density perimeter surface.

4. The antenna assembly of claim 1, where the nonconductive frame comprises at least one channel positioned over at least a portion of the signal conductor.

* * * * *